US005672052A

United States Patent [19]

Ishida et al.

[11] Patent Number: 5,672,052

[45] Date of Patent: Sep. 30, 1997

[54] BLOWER MUFFLING APPARATUS

[75] Inventors: Fumiaki Ishida, Narashino; Masayuki Fujio, Sakura; Hiromoto Ashihara, Fukuoka; Takeshi Moritake, Narashino, all of Japan

[73] Assignee: Hitachi, Ltd., Tokyo, Japan

[21] Appl. No.: 597,045

[22] Filed: Feb. 5, 1996

[30] Foreign Application Priority Data

Feb. 20, 1995 [JP] Japan ..... 7-030417

[51] Int. Cl.[6] ..... F04B 39/00

[52] U.S. Cl. ..... 417/312; 417/423.5; 415/119; 181/202

[58] Field of Search ..... 417/312, 423.8, 417/423.14, 423.5; 181/198, 200, 202, 212, 264; 415/119

[56] References Cited

U.S. PATENT DOCUMENTS

| | | | |
|---|---|---|---|
| 1,610,774 | 12/1926 | Hanson | 417/312 |
| 3,736,074 | 5/1973 | Kilbane et al. | 417/312 |
| 3,989,415 | 11/1976 | Van-Hee et al. | 417/312 |
| 4,264,282 | 4/1981 | Crago | 417/312 |
| 5,407,330 | 4/1995 | Rimington et al. | 417/312 |

FOREIGN PATENT DOCUMENTS

| | | |
|---|---|---|
| 2 266 251 | 10/1975 | France . |
| 44 23 455 A1 | 1/1995 | Germany . |
| 61-259000 | 11/1986 | Japan . |
| 3-253800 | 11/1991 | Japan . |
| 2 271 811 | 4/1994 | United Kingdom . |

*Primary Examiner*—Timothy Thorpe
*Assistant Examiner*—Peter G. Korytnyk
*Attorney, Agent, or Firm*—Antonelli, Terry, Stout & Kraus, LLP.

[57] ABSTRACT

A blower muffling apparatus includes a blower chamber for housing a blower therein, an exhaust chamber positioned adjacent the blower body side of a blower disposed in the blower chamber, communicating in one of upper and lower portions with the blower chamber, and having an exhaust port in the other portion, a muffling passage chamber disposed adjacent the blower chamber in the axial direction of the blower, and having one end communicating with the other portion of the exhaust chamber and the other end communicating with a discharge port of the blower through a flexible exhaust duct, and a duct accommodating chamber for accommodating the flexible exhaust duct therein, each of the chambers being surrounded by a sound-absorbing material. Exhaust gas of the blower is discharged from the flexible exhaust duct through the muffling passage chamber and the exhaust chamber to thereby absorb exhaust noise of the blower.

15 Claims, 10 Drawing Sheets

BLOWER MUFFLING APPARATUS

BACKGROUND OF THE INVENTION

1. Field of the Invention

The present invention relates to a blower muffling apparatus with which the whole of a blower is housed in a box provided with a sound-absorbing material therein to suppress leakage of sounds produced by the blower to the exterior.

2. Description of the Related Art

With an increase in requirements for a reduced size and weight, higher discharge pressure and lower noise of blowers themselves, various studies on the configuration and structure of a vane wheel of the blower have been recently made. Concurrently, a reduction in size and noise is also required in muffling apparatus to further reduce noise of blowers.

In such a muffling apparatus, the whole of a blower is conventionally housed in a box provided with a sound-absorbing material therein and an intake port and a discharge port of the blower are communicated with the exterior through pipes. It is also known to entirely or partially construct the box with a double-wall structure.

As references for the art of blower muffling, there are known Japanese Patent Unexamined Publication No. 61-259000 and No. 3-253800.

The conventional muffling apparatus mentioned above are highly effective in absorbing sounds produced by blowers per se. But because the discharge port is directly communicated with the exterior through the pipe, exhaust noise of the blower is leaked to the exterior through the pipe. In one prior art, therefore, an auxiliary silencer is mounted to a pipe disposed on the discharge side so that exhaust noise conducted outside may be absorbed by the auxiliary silencer. With this arrangement, however, the muffling box and the separate auxiliary silencer are both required. Furthermore, the apparatus utilizing the muffling box is generally apt to have a relatively large size. This is because an ample space is needed within the muffling box to treat a great amount of heat produced by the blower per se.

SUMMARY OF THE INVENTION

The present invention has been accomplished in view of the problems as set forth above, and an object of the intention is to provide a muffling apparatus which can reduce exhaust noise of a blower without needing a special silencer.

Another object of the present invention is to provide a muffling apparatus which can be made small size.

To achieve the above objects, a feature of the present invention resides in a blower muffling apparatus in which a blower comprising a blower body on one side of an electric motor in the axial direction and a self-operated cooling fan on the other side of the motor and having an intake port and a discharge port in a lower portion on the side of the cooling fan is housed, wherein the blower muffling apparatus comprises a blower chamber for housing the blower therein, an exhaust chamber positioned adjacent the blower chamber on the side of the blower body of the blower, communicating in one of upper and lower portions with the blower chamber, and having an exhaust port in the other portion, a muffling passage chamber disposed adjacent the blower chamber in the axial direction of the blower, and having one end communicating with the other portion of the exhaust chamber and the other end communicating with the discharge port of the blower through a flexible exhaust duct, and a duct accommodating chamber for accommodating the flexible exhaust duct therein, each of the chambers being surrounded by a sound-absorbing material.

Another feature of the present invention resides in a blower muffling apparatus in which a blower comprising a blower body on one side of an electric motor in the axial direction and a self-operated cooling fan on the other side of the motor and having an intake port and a discharge port in a lower portion on the side of the cooling fan is housed, wherein the blower muffling apparatus comprises a blower chamber for housing the blower therein; a cooling air supply system including a cooling air take-in chamber positioned axially Of the blower chamber and having a cooling air take-in hole formed in one side thereof, a cooling air introduction chamber positioned on the side of the cooling fan of the blower, communicating in one side with the cooling air take-in chamber, and having a cooling air introduction hole in a position corresponding to the cooling fan of the blower, an upper cooling air introduction chamber communicating with the an upper portion of the cooling air introduction chamber and provided with a separately-operated cooling fan for introducing the cooling air to the blower chamber, and an intermediate chamber positioned between the cooling air take-in chamber and the blower chamber and having a cooling air intake in communication with the cooling air take-in chamber; an exhaust chamber positioned adjacent the blower chamber on the side of the blower body of the blower, communicating with the blower chamber at least in an upper portion of the blower chamber, and having an exhaust port in its lower portion; a muffling passage chamber disposed above the blower chamber on the other side of the cooling air take-in chamber, and having one end communicating with an upper portion of the exhaust chamber and the other end communicating with the discharge port of the blower through a flexible exhaust duct, the muffling passage chamber having a cross-sectional area substantially equal to that of the flexible exhaust duct; and a duct accommodating chamber for accommodating the flexible exhaust duct therein, each of the chambers being surrounded by a sound-absorbing material.

With the arrangement set forth above, exhaust gas discharged from the discharge port of the blower enters, through the flexible exhaust duct, the muffling passage chamber where exhaust noise is reduced, and then enters the exhaust chamber where exhaust noise is further reduced. Accordingly, the muffling apparatus capable of reducing the exhaust noise of the blower can be achieved without requiring any special silencer.

Also, with the various chambers partitioned and arranged in a rational manner as stated above, one part of the cooling air taken into the cooling air take-in chamber through the cooling air introduction hole is forcibly sent into the blower chamber by the separately-operated cooling fan for efficiently cooling the blower. The other part of the cooling air taken into the cooling air take-in chamber through the cooling air take-in hole is led to the cooling air introduction chamber under the action of the cooling fan mounted to the blower, followed by being fed into the blower chamber by the cooling fan. Therefore, a sufficient amount of cooling air is supplied to the blower. Then, the cooling air thus fed into the blower chamber cools the blower and, thereafter, enters the exhaust chamber from which it is exhausted to the exterior through the exhaust port. The exhaust gas discharged from the discharge port of the blower is introduced through the flexible exhaust duct to the muffling passage chamber from which it enters the exhaust chamber, followed by being exhausted through the exhaust port. During this exhausting route, exhaust noise is first reduced in the muffling passage chamber and then further reduced in the exhaust chamber. With such a structure, a vent passage for lowering a temperature rise due to heat generated by the blower and a vent passage for reducing the exhaust noise can be separated from each other, allowing the cooling air and the discharge air to be joined together in the exhaust chamber. As a result, the heat generated by the blower can be efficiently removed and the blower muffling apparatus having a reduced sized can be achieved.

DETAILED DESCRIPTION OF THE PREFERRED EMBODIMENTS

Figure 1:
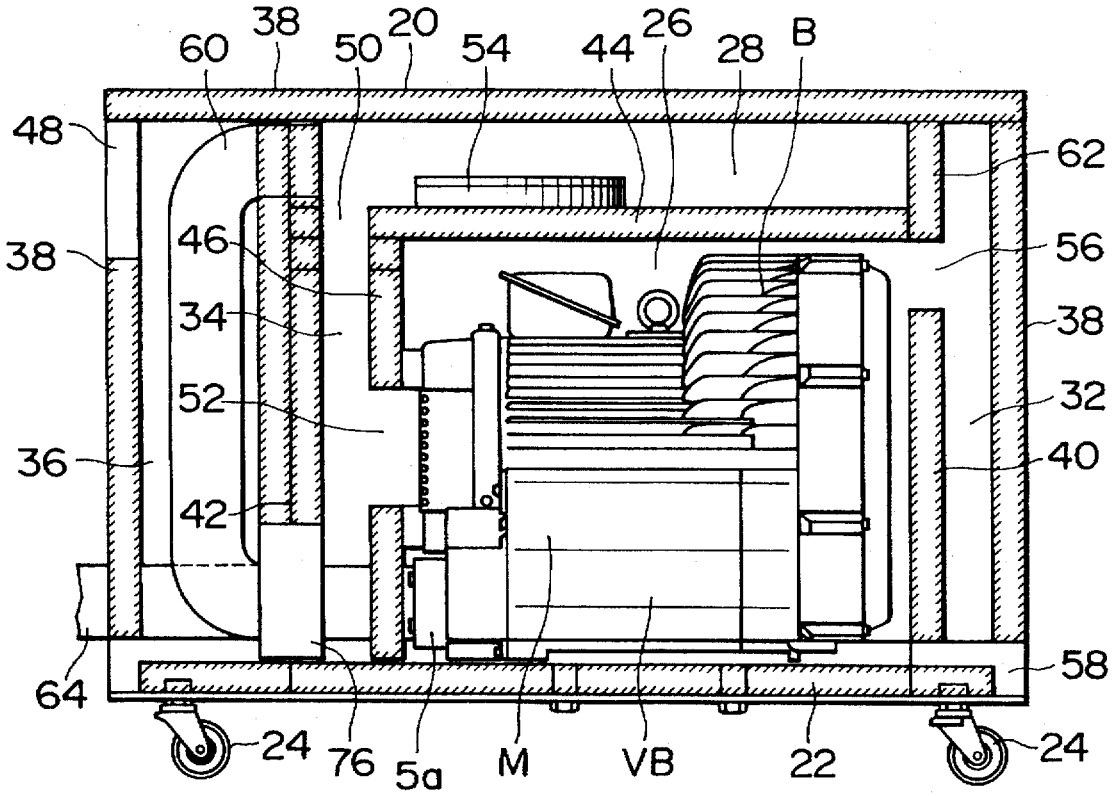
FIG. 1 is a front view, partly sectioned, of one embodiment of the present invention.

Preferred embodiments of the present invention shown in the drawings will be described below.

Figure 6:
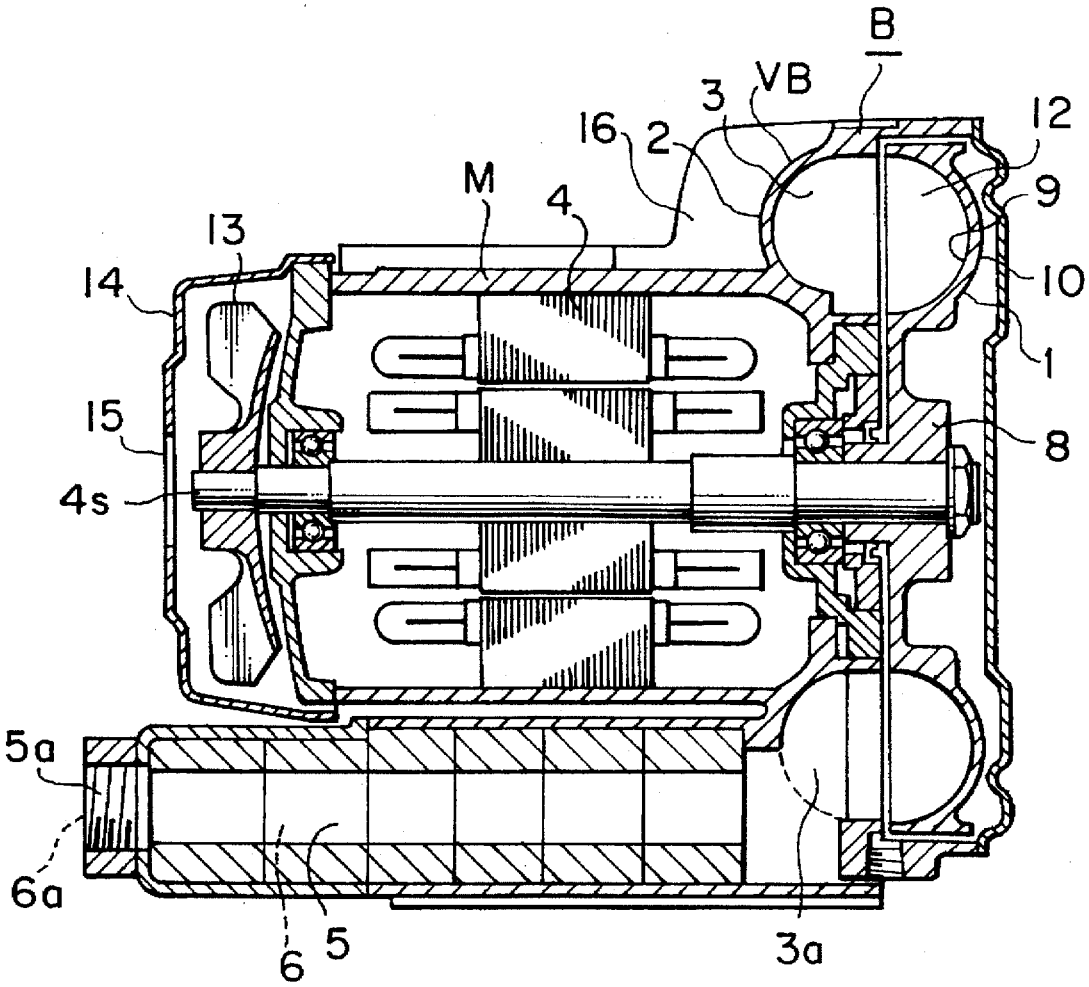
FIG. 6 is a sectional view of a volute type blower for use in the embodiment of the present invention.

FIG. 6 is a side view, partly sectioned, of a volute type blower for use in the embodiment of the present invention. In FIG. 6, a volute type blower VB comprises a blower section B and a motor section M for driving the blower into rotation. Denoted by reference numeral 1 is a vane wheel, the numeral 2 denotes a casing forming a pressure boosting passage 3 therein, the numeral 4 denotes an electric motor for driving the vane wheel 1, the numeral **4*s* denotes a rotary shaft of the motor 4. The pressure boosting passage 3 has one end connected to a discharge side passage 5 and the other end connected to an intake side passage 6 not appearing in FIG. 6. Additionally, the numeral 5*a* denotes a discharge port and the numeral 6*a* an intake port. The discharge side passage 5 and the intake side passage 6 are provided parallel to each other. The pressure boosting passage 3 is configured annularly about the center of rotation of the vane wheel 1, i.e., the rotary shaft 4*s* of the motor 4, and is in the form of a groove being semicircular in cross-section and open in a direction parallel to the rotary shaft 4*s*. Then, a partition 3*a* is disposed between the discharge side passage 5 and the intake side passage 6 so as to block off the pressure boosting passage 3**.

The vane wheel 1 is fixed to the rotary shaft **4*s* of the motor 4, and comprises a wheel 8 rotatable about the rotary shaft 4*s*, a hub 10 forming an annular groove 9 being open in the direction parallel to the rotary shaft 4*s* to face the pressure boosting passage 3, and a number of vanes 12 disposed in and across the annular groove 9 so as to divide the annular groove 9 circumferentially. Denoted by the numeral 13 denotes a cooling fan fixed to the rotary shaft 4*s* of the motor 4 in opposite relation to the vane wheel 1, the numeral 14 denotes a fan cover surrounding the cooling fan 13, and the numeral 15 denotes a cooling air inlet provided at the center of the fan cover 14. The numeral 16** denotes a cooling fin provided on an outer frame of the blower VB.

In using the blower VB, when the vane wheel 1 is driven into rotation by the motor 4, a gas is sucked from the intake port **6*a* through the intake side passage 6 under the action of the vane wheel 2, and the sucked gas is gradually pressurized while producing whirling flows in such a manner that the gas is pressurized by the vane 12 to be introduced from the side of the hub 10 to the pressure boosting passage 3 and, thereafter, is returned back into the hub 10 again. The gas is finally transferred to the discharge side passage 5. Then, the gas under a high pressure passes through the discharge side passage 5 with the aid of the partition 3*a* and is discharged from the discharge port 5*a*. On the other hand, with the rotation of the motor 4, the cooling fan 13 takes in cooing air through the cooling air inlet 15 and blows the taken-in air out along the cooling fins 16** for cooling the blower VB.

Figure 2:
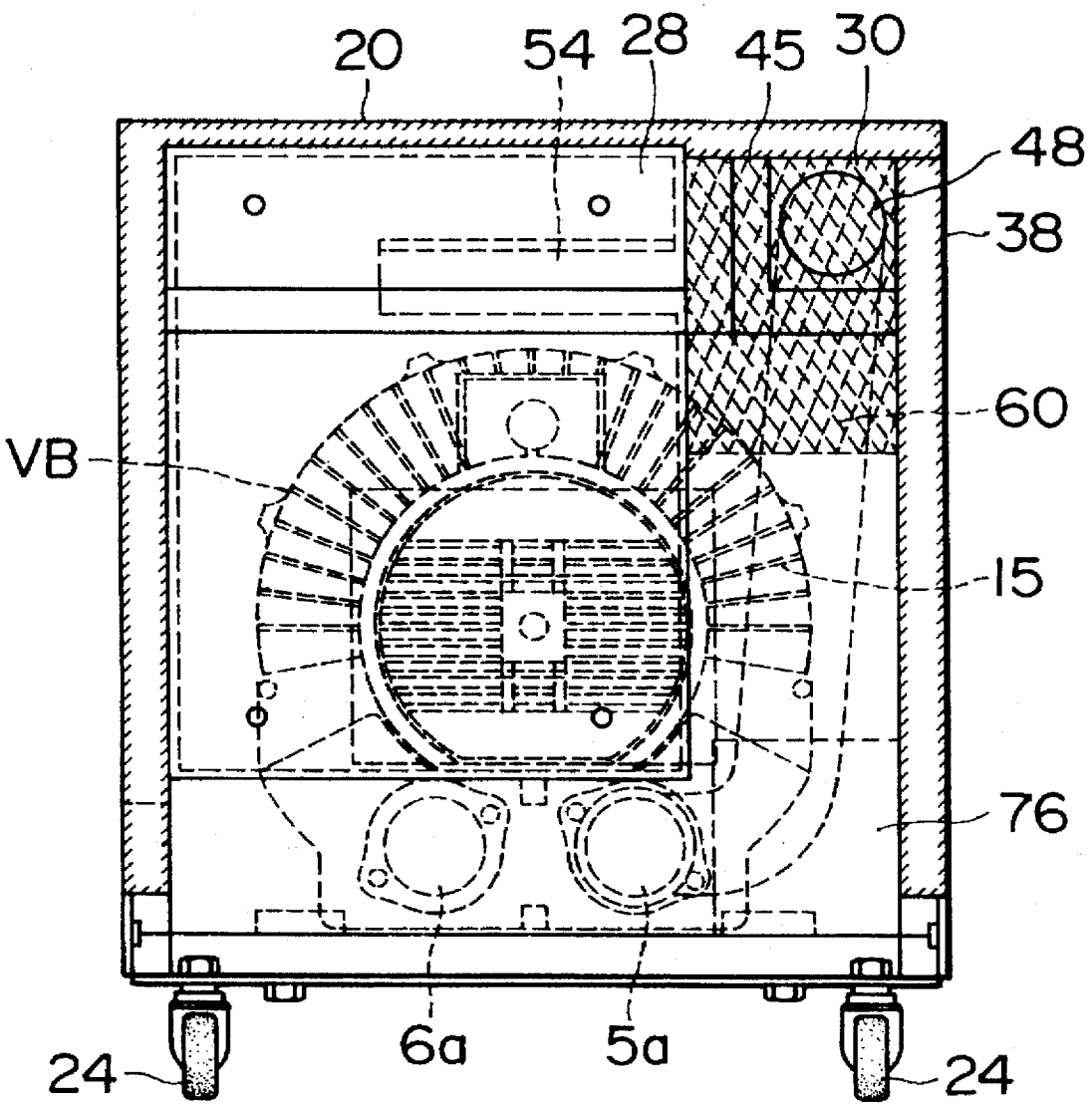
FIG. 2 is a left side elevational view of one embodiment of the present invention.
Figure 3:
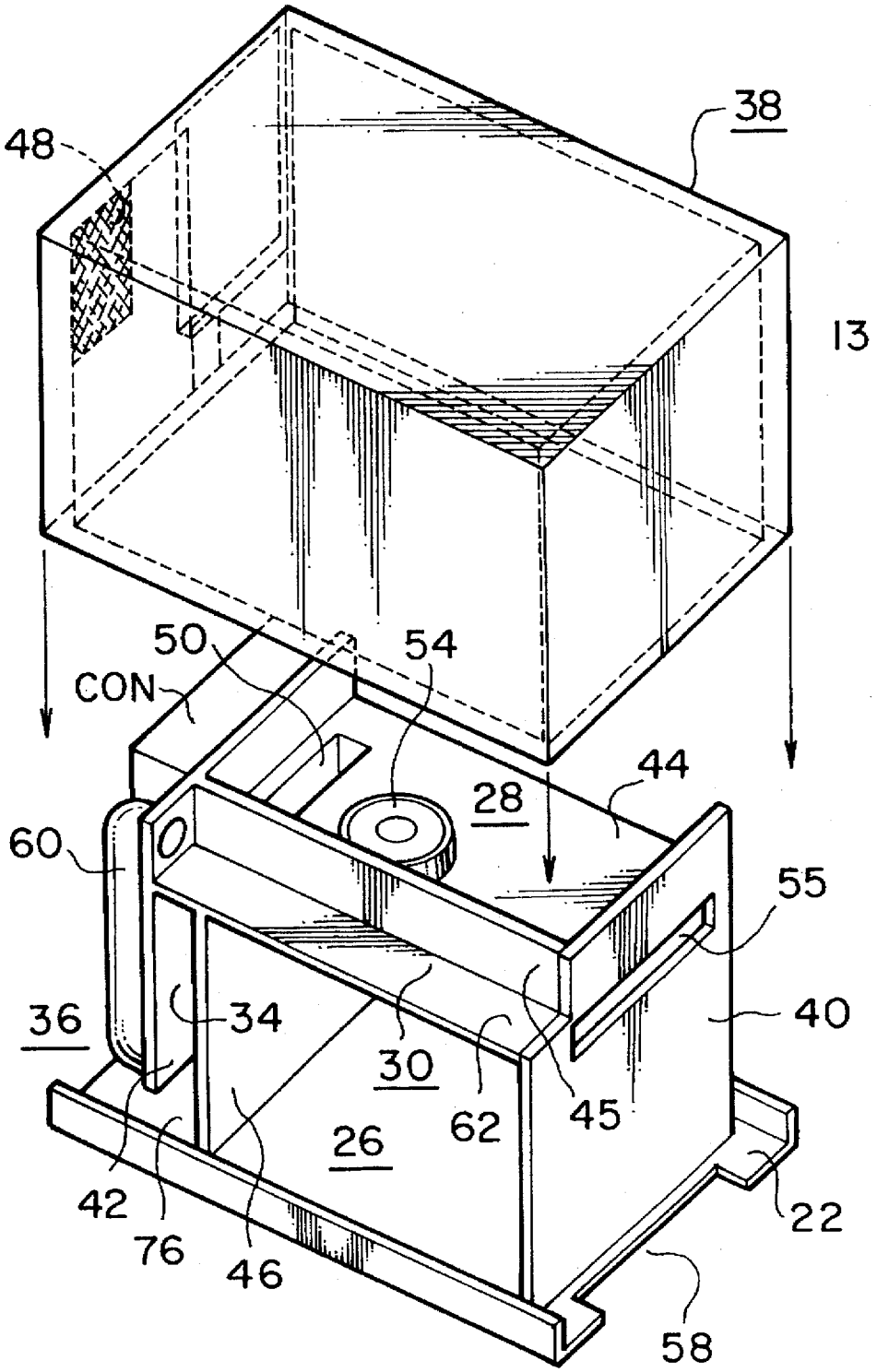
FIG. 3 is an exploded structural view of a muffling apparatus according to one embodiment of the present invention.

FIGS. 1 and 2 illustrate one embodiment in which; FIG. 1 is a front view, partly sectioned, and FIG. 2 is a left-side elevational view. FIG. 3 is a perspective view with an outer box, serving as an outer wall, separated in an exploded manner. A muffling apparatus 20 of this embodiment has a box-shaped appearance. Casters 24 are attached to the underside of a base member 22 at four corners, allowing the muffling apparatus to be easily moved as a whole. Various chambers are defined within the muffling apparatus 20 by partitions. First of all, a blower chamber 26 housing the blower VB therein is defined at the center thereof. Above the blower chamber 26, an upper cooling air introduction chamber 28 and a muffling passage chamber 30 are then defined so as to axially extend in parallel. An exhaust chamber 32 is defined adjacent the blower chamber 26 on the side where the blower section B is arranged. A cooling air introduction chamber 34 is defined adjacent the blower chamber 26 on the opposite side thereof, and a duct accommodating chamber 36 is defined outwardly of the cooling air introduction chamber 34. Denoted by the numeral 38 is an outer wall defining the box. The numeral 40 denotes a partition for axially partitioning a space in the box to define the exhaust chamber 32 between the outer wall 38 and the blower chamber 26. The numeral 42 denotes a partition for defining the duct accommodating chamber 36 between the partition 40 and the outer wall 38 on the opposite side thereof to the blower chamber 26. The numeral 44 denotes a partition for vertically partitioning a space between the partition 40 and the partition 42 to define the upper cooling air introduction chamber 28 and the muffling passage chamber 30 on the upper side thereof, and the blower chamber 26 and the cooling air introduction chamber 34 on the lower side thereof. The numeral 45 denotes a partition for horizontally partitioning the space, which is defined by the partition 44 thereabove, into the upper cooling air introduction chamber 28 and the muffling passage chamber 30. The numeral 46 denotes a partition for axially partitioning the space, which is defined by the partition 44 thereunder, into the blower chamber 26 and the cooling air introduction chamber 34.

Denoted by the numeral 48 is a cooling air inlet hole formed in the outer wall 38 for communicating the duct accommodating chamber 36 with the outer air. The cooling air inlet hole 48 allows the outer cooling air to be taken into the duct accommodating chamber 36 therethrough. The numeral 76 denotes an opening formed in the partition 42 to serve as a cooling air take-in hole of a cooling air take-in chamber for communicating the cooling air take-in chamber and the cooling air introduction chamber 34 with each other. The numeral 52 denotes an opening formed in the partition 46 to serve as a cooling air introduction hole for communicating the blower chamber 26 and the cooling air introduction chamber 34 with each other. The opening 52 is positioned such that it faces the cooling air inlet 15 of the blower VB when the blower VB is installed in the blower chamber 26. The numeral 54 denotes a separately operated cooling fan provided in the partition 44 above the blower chamber 26 and positioned such that, when driven, it blows the cooling air taken into the upper cooling air introduction chamber 28 toward the blower VB from above. The numeral 56 denotes an opening formed in the partition 40 located above the blower chamber 26 in such a position as to communicate the blower chamber 26 and the exhaust chamber 32 with each other. The numeral 58 denotes an opening formed in the outer wall 38 to serve as an exhaust port located at the bottom of the exhaust chamber 32 in such a position as to communicate the exhaust chamber 32 with the outer air. The numeral 60 denotes a flexible duct disposed in the duct accommodating chamber 36, and has one end penetrating both the partition 42 and the partition 46 to be connected to the discharge port **5*a* of the blower VB and the other end penetrating the partition 42 to be connected to the muffling passage chamber 30. The numeral 62 denotes an opening formed in the partition 40 for communicating an opposite end of the muffling passage chamber 30, which is not communicated with the duct 60, with the exhaust chamber 32. The opening 62 has an aperture area comparable to or greater than a cross-sectional area of the muffling passage chamber 30. The numeral 64 denotes a pipe for connecting the intake port 6*a* of the blower VB to an external load, for example, while penetrating the outer wall 38 and the partition 42. Additionally, a sound-absorbing material, of which properties and thickness are selected so as to exhibit high acoustic absorptivity for sounds in frequencies produced by the blower VB, is attached to surrounding walls of each of the chambers defined by the partitions. "CON" denotes a control panel or an inverter disposed in the duct accommodating chamber 36. Note that the cooling air take-in chamber, the cooling air introduction chamber 34, the upper cooling air introduction chamber 28**, and an intermediate chamber described later jointly make up a cooling air supply chamber.

Figure 4:
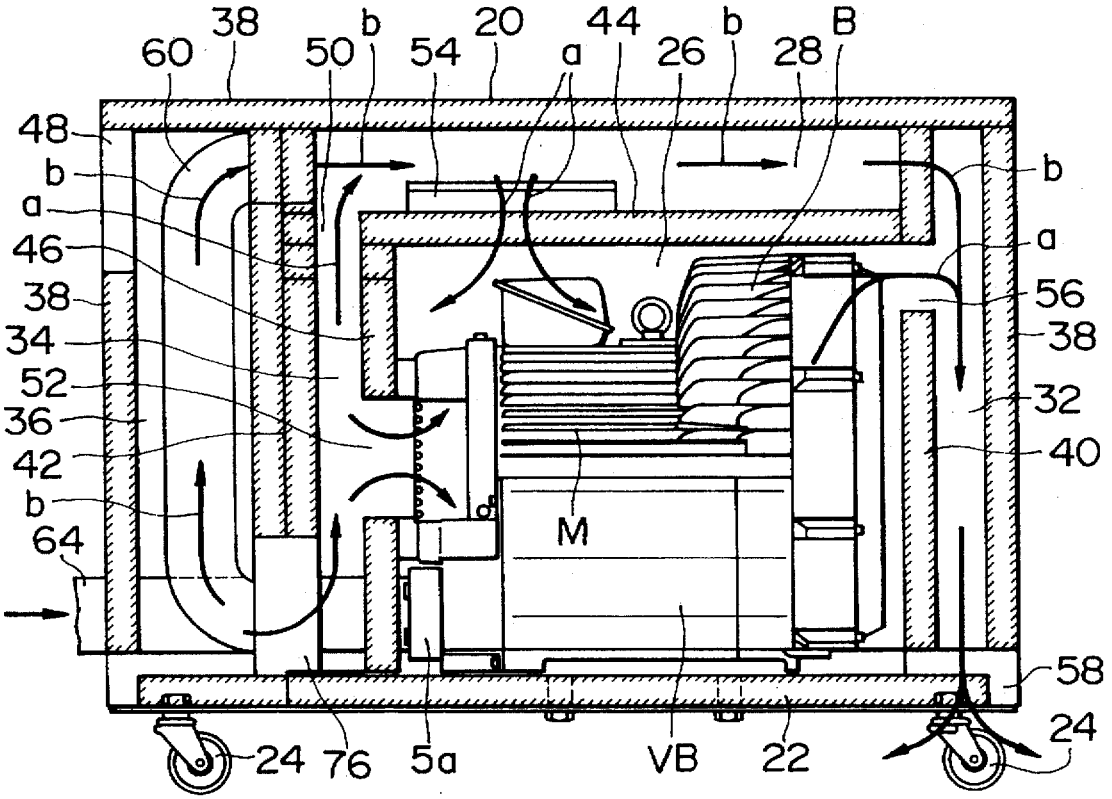
FIG. 4 is a front view, partly sectioned, showing flows of internal air in one embodiment of the present invention.
Figure 5:
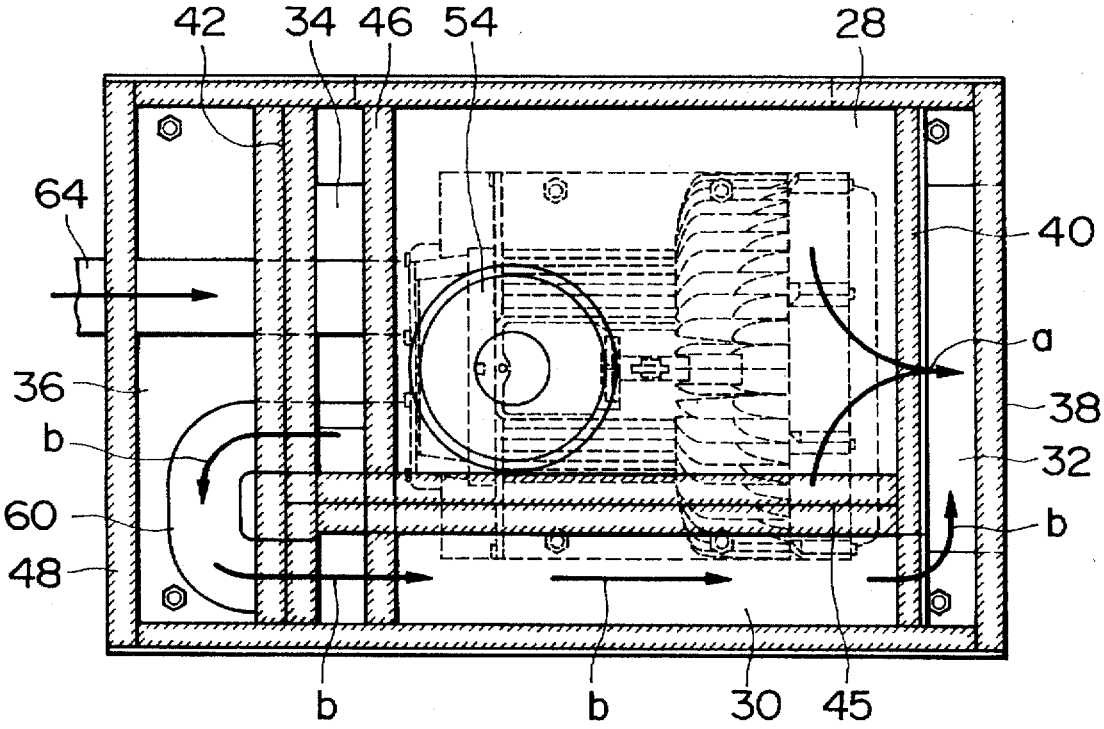
FIG. 5 is a plan view, partly sectioned, showing flows of internal air in one embodiment of the present invention.

FIGS. 4 and 5 illustrate flows of the cooling air and discharge flows of the blower VB that are generated in the thus-constructed box when the blower VB and the separately operated cooling fan 54 are driven. FIG. 4 is a partly sectioned front view and FIG. 5 is a partly sectioned plan view. With reference to these figures, a description will be made below on the flows of the cooling air and the discharge flows of the blower VB that are generated when the blower VB and the separately operated cooling fan 54 are driven. When the motor 4 is energized to drive the blower VB and the separately operated cooling fan 54, the cooling air taken into the duct accommodating chamber 36 through the cooling air inlet hole 48 first passes the cooling air take-in chamber having the cooling air take-in hole 76 formed in the partition 42 and then enters the cooling air introduction chamber 34. With the blower driven, one part of the cooling air is attracted toward the fan cover 14 through the opening 52 for cooling the volute type blower VB while flowing between the cooling fins 16 on the blower VB. The other part of the introduced cooling air passes the intermediate chamber having the cooling air intake 50 formed in the partition 44 and then enters the upper cooling air introduction chamber 28 from which the cooling air is blown by the separately operated cooling fan 54 toward the blower VB from above, thereby cooling the blower VB. The air supplied to the blower chamber 26 and utilized for cooling the blower VB is exhausted from the blower chamber 26 to the exhaust chamber 32 through the opening 56. Arrows a indicate the air flows in the above cooling process. On the other hand, the air sucked through the pipe 64 and pressurized by the blower VB is discharged through the discharge port **5*a*. The discharged air passes the flexible duct 60 to enter the muffling passage chamber 30 from which it is exhausted to the exhaust chamber 32 through the opening 62. Arrows b indicate the air flows in the above exhausting process. Exhaust noise produced by the blower VB is absorbed by the sound-absorbing material while the exhaust air is passing the muffling passage chamber 30. The air flows having entered the exhaust chamber 32 through the opening 56 and the opening 62 are joined together there and then exhausted through the exhaust port 58. In the exhaust chamber 32**, the exhaust noise is further absorbed by the sound-absorbing material.

Thus, in the illustrated embodiment, the muffling passage chamber 30 is capable of reducing the exhaust noise in combination of reactance and resistance type muffling structures. Generally, frequencies of exhaust noise produced by a blower, e.g., a volute type blower employed in the embodiment, is centered at:

exhaust noise frequency (Hz)=operation frequency (Hz) x number of vanes of blower vane wheel By not only selecting a sound-absorbing material of which properties and thickness exhibit high acoustic absorptivity for such a frequency generated by the volute type blower VB, but also modifying the configuration of the muffling passage chamber in utilization of the length and width of the muffling box depending on that frequency, it is possible to set the frequency in design at which the effect of a reactance type muffler is maximized.

Further, with this embodiment, since the muffling passage chamber 30 is completely separated from the blower chamber 26 and is covered by the sound-absorbing material, outflow of heat to the blower chamber 26 is very small due to small thermal conductivity of the sound-absorbing material. Additionally, since the separately operated cooling fan 54 is employed for forced ventilation in this embodiment, the box size can be made relatively compact for the rated calorific value of the volute type blower VB.

Figure 7A:
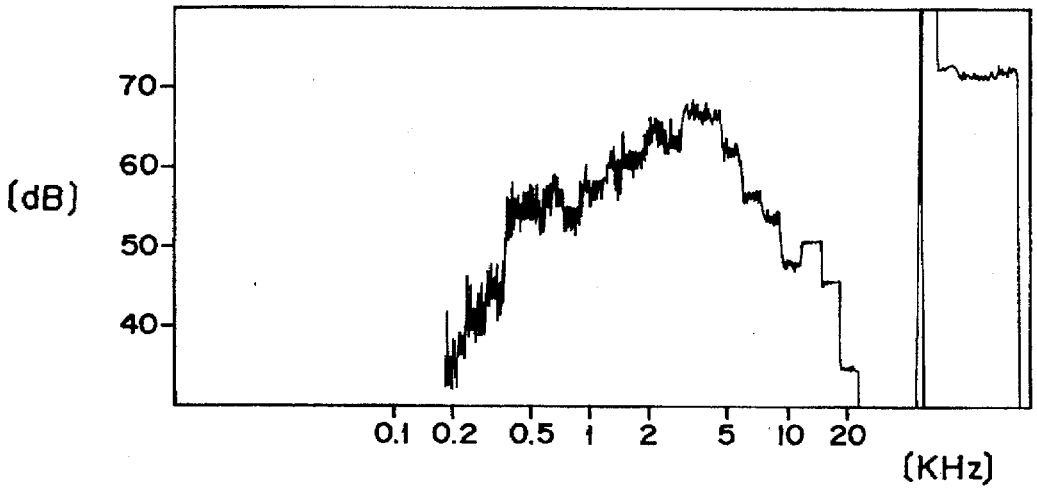
FIG. 7A is a chart showing results of a noise versus frequency analysis for the volute type blower alone.
Figure 7B:
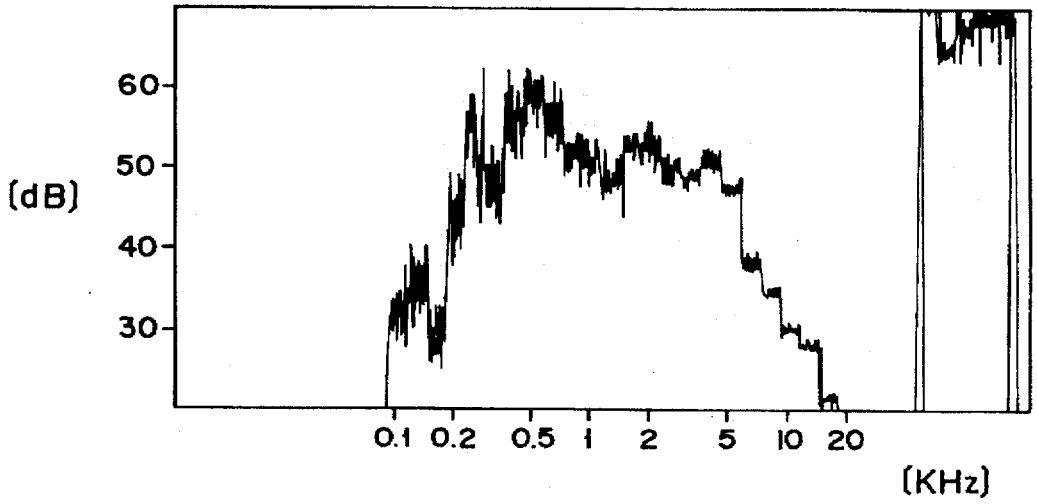
FIG. 7B is a chart showing results of a noise versus frequency analysis when the volute type blower is enclosed in a typical prior art muffling box.
Figure 8A:
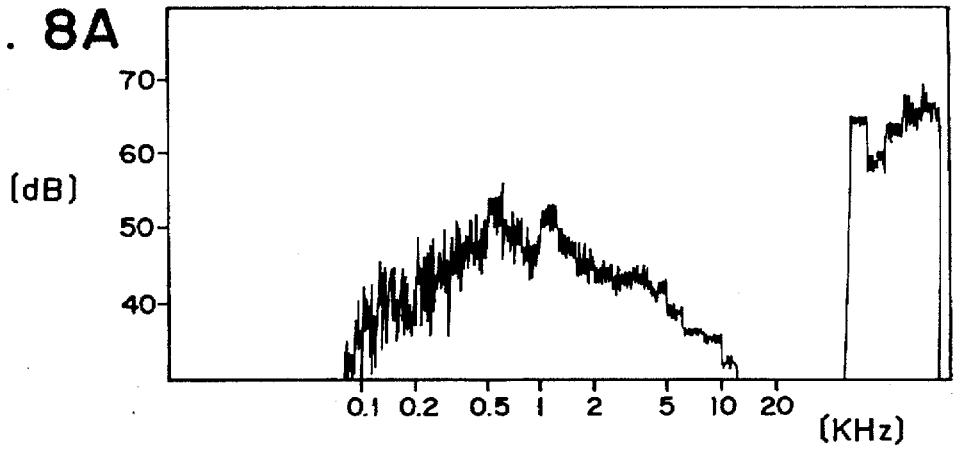
FIG. 8A is a chart showing results of a noise versus frequency analysis when a conventional muffling box is employed and an auxiliary silencer is additionally attached to a discharge port.
Figure 8B:
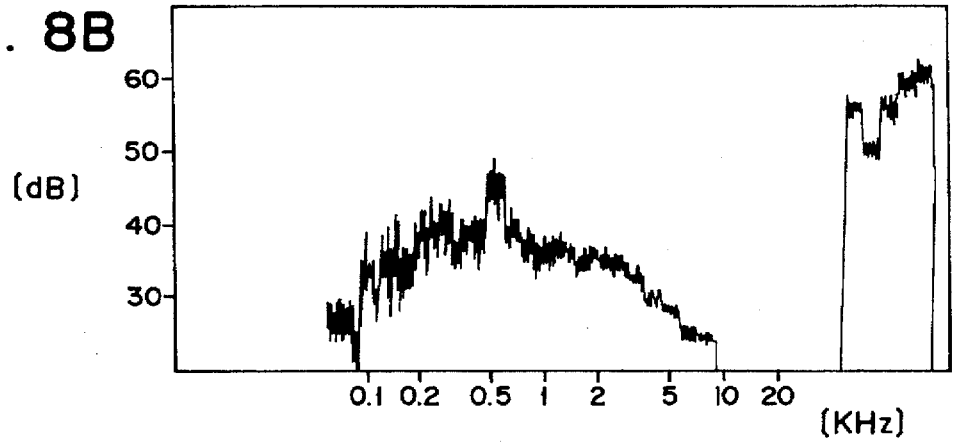
FIG. 8B is a chart showing results of a noise versus frequency analysis when a conventional muffling box and the auxiliary silencer are employed and a muffling duct is attached to the auxiliary silencer.
Figure 8C:
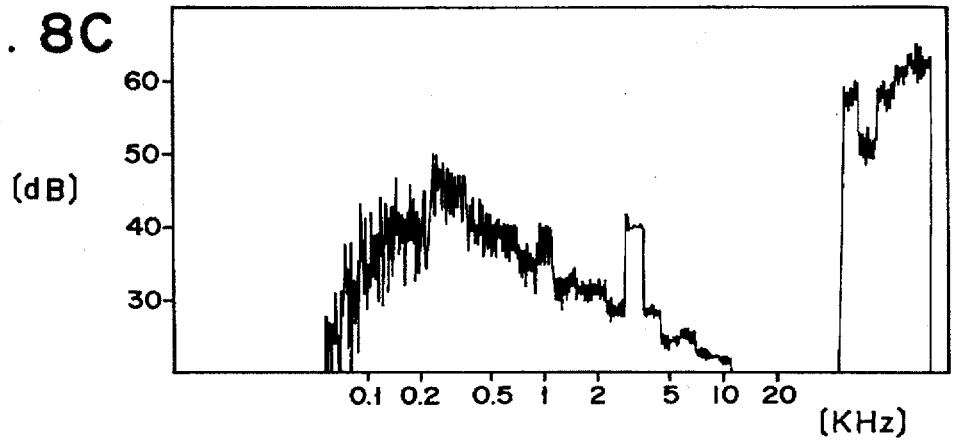
FIG. 8C is a chart showing results of a noise versus frequency analysis for one embodiment of the present invention.

FIGS. 7 and 8 plot characteristic charts resulted from selecting a volute type blower as the blower and installing it in various conditions. In each of the charts, the vertical axis represents a noise [dB] and the horizontal axis represents a frequency [kHz]. FIG. 7A shows results of a noise versus frequency analysis for the volute type blower alone. FIG. 7B shows results of a noise versus frequency analysis when the volute type blower is enclosed in a conventional typical muffling box. FIG. 8A shows results of noise versus frequency analysis when the conventional muffling box is employed and an auxiliary silencer is additionally attached to a discharge port. FIG. 8B shows results of noise versus frequency analysis when the conventional muffling box and the auxiliary silencer are employed and a muffling duct is attached to the auxiliary silencer. FIG. 8C shows results of noise versus frequency analysis for this embodiment. The overall noise value (the comparison will be made in terms of overall noise value hereinafter) in the case of the volute type blower alone is reduced about 9 dB (A) by enclosing the volute type blower in the conventional typical muffling box. It is then reduced about 4 dB (A) by installing the auxiliary silencer to the discharge port and further about 4 dB (A) by employing the additional muffling duct. In total, a noise reduction of 17 dB (A) is realized. By contrast, the noise value is reduced 17 dB (A) in the muffling box of this embodiment with respect to the case of the volute type blower alone. It is thus understood that the noise reduction effect comparable to that found in the conventional apparatus provided with both the auxiliary silencer and the muffling duct is achieved in a much more compact size.

Figure 9A:
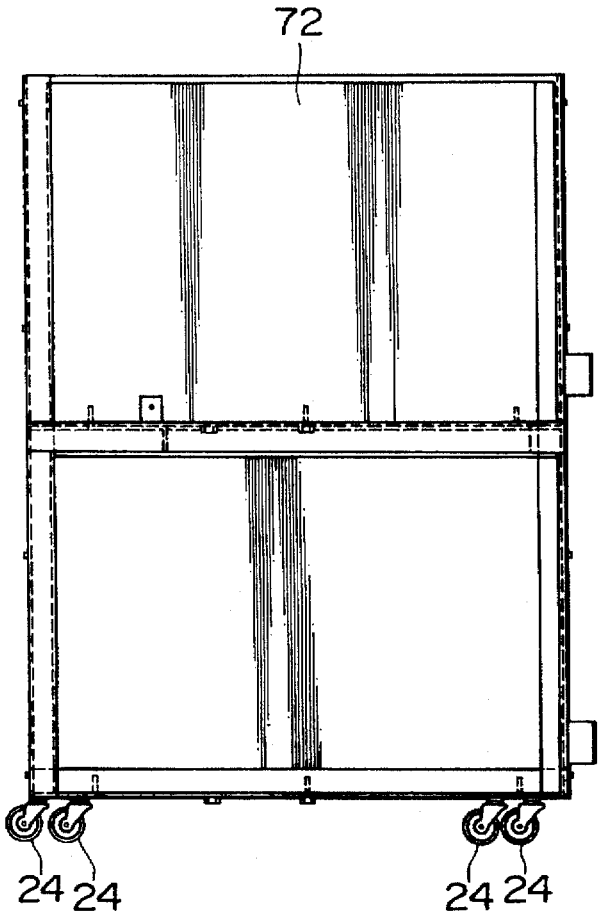
FIG. 9A is a front view showing another embodiment of the present invention.
Figure 9B:
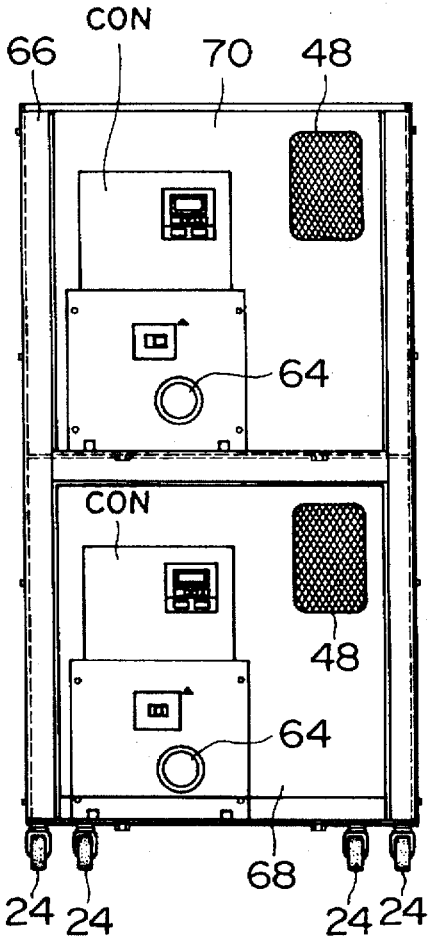
FIG. 9B is a side view showing another embodiment of the present invention.
Figure 10:
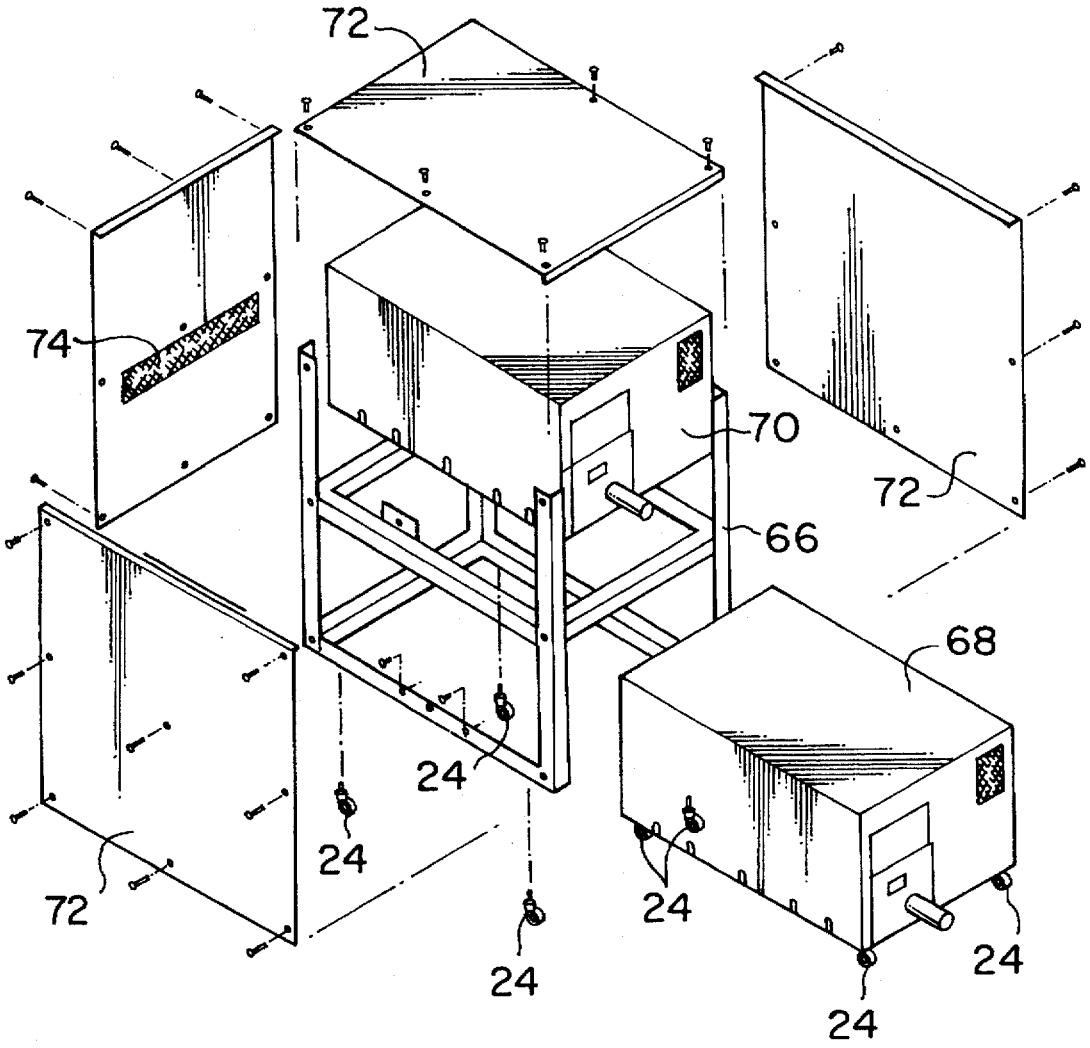
FIG. 10 is an exploded structural view of the embodiment shown in FIGS. 9A and 9B.

When a large flow rate of air is further needed, it is envisaged to employ the muffling apparatus of this embodiment in plural. But since the muffling apparatus is generally employed indoor, using a plurality of muffling apparatus would require a floor area for installation corresponding to the unit area multiplied by the number of apparatus used. In view of the above, FIGS. 9 and 10 show an embodiment wherein the flow rate of air can be increased several times by stacking the muffling apparatus in several stages without enlarging the floor area for installation. Because the muffling apparatus has the cooling air inlet hole 48 formed in a surface of the outer wall 38 which is perpendicular to the blower axis and the exhaust port 58 formed in an opposite surface of the outer wall 38, the degree of freedom in design is improved for installing the plurality of apparatus. As shown in FIG. 10, two muffling apparatus 68, 70 having the same construction are stacked vertically in two stages using a frame 66, and casters 24 for movement are attached to each of the frame 66 and the lower-stage apparatus 68 in consideration of the efficiency of maintenance and service work. For an improvement of an appearance, facing plates 72 may be attached to surrounding surfaces of the frame 66. In this case, however, an exhaust opening 74 must be formed in the facing plate in opposite relation to the discharge port of the upper-stage apparatus 70.

According to the present invention, as will be apparent from the above description, the muffling apparatus capable of reducing the exhaust noise of the blower can be achieved without requiring any special silencer.

Also, the blower muffling apparatus capable of reducing a size can be obtained.

What is claimed is:

1. A blower muffling apparatus which houses a blower comprising a blower body on one side of an electric motor in the axial direction and a cooling fan on the other side of said motor and having an intake port and a discharge port in a lower portion thereof on the side of said cooling fan, said blower muffling apparatus comprising:

a blower chamber for housing said blower therein, an exhaust chamber positioned adjacent said blower chamber on the side of the blower body of said blower, communicating with said blower chamber, and having an exhaust port, a muffling passage chamber disposed adjacent said blower chamber in the axial direction of said blower, and having one end communicating with said exhaust chamber and the other end communicating with the discharge port of said blower through a flexible exhaust duct, and a duct accommodating chamber for accommodating said flexible exhaust duct therein, each of said chambers being surrounded by a sound-absorbing material.

2. A blower muffling apparatus according to claim 1, wherein each of said chambers is defined by an outer wall forming an entirety of said apparatus above a base member and partitions positioned within said outer wall.

3. A blower muffling apparatus according to claim 1, wherein said muffling passage chamber is disposed above said blower chamber and is communicated with said exhaust chamber through an opening.

4. A blower muffling apparatus according to claim 1, wherein said exhaust chamber is communicated with said blower chamber through an opening formed in said exhaust chamber, and said exhaust port is formed at a bottom of said exhaust chamber.

5. A blower muffling apparatus which houses a blower comprising a blower body on one side of an electric motor in the axial direction and a cooling fan on the other side of said motor and having an intake port and a discharge port in a lower portion on the side of said cooling fan, said blower muffling apparatus comprising:

a blower chamber for housing said blower therein, a cooling air supply system provided for said blower chamber and for supplying cooling air to said cooling fan of said blower directly and said blower chamber from above, an exhaust chamber positioned adjacent said blower chamber on a side of the blower body of said blower, communicating with said blower chamber and having an exhaust port in a lower portion, thereof a muffling passage chamber disposed adjacent said cooling air supply system above said blower chamber, and having one end communicating with of said exhaust chamber and the other end communicating with the discharge port of said blower through a flexible exhaust duct, and a duct accommodating chamber for accommodating said flexible exhaust duct therein, each of said chambers being surrounded by a sound-absorbing material.

6. A blower muffling apparatus according to claim 5, wherein said cooling air supply system includes:

a cooling air take-in chamber positioned axially of said blower and having a cooling air take-in hole formed in a wall surface thereof, an intermediate chamber positioned between said cooling air take-in chamber and said blower chamber and having a cooling air intake in communication with said cooling air take-in chamber, an upper cooling air introduction chamber communicating with said intermediate chamber and positioned above said blower chamber for feeding the cooling air to said blower chamber by a separately-operated cooling fan, and a cooling air introduction chamber positioned on the side of said cooling fan of said blower, communicating with said cooling air take-in chamber, and having a cooling air introduction hole in a position corresponding to said cooling fan of said blower.

7. A blower muffling apparatus according to claim 5, wherein each of said chambers is defined by an outer wall forming an entirety of said apparatus above a base member and partitions positioned within said outer wall.

8. A blower muffling apparatus according to claim 5, wherein said muffling passage chamber and said upper cooling air introduction chamber are disposed in parallel.

9. A blower muffling apparatus according to claim 5, wherein said duct accommodating chamber is communicated with said cooling air take-in chamber through the cooling air introduction hole thereof, and having a cooling air inlet hole formed in said outer wall.

10. A blower muffling apparatus according to claim 5, wherein said exhaust chamber is communicated with upper portions of said muffling passage chamber and said blower chamber through respective openings.

11. A blower muffling apparatus which houses a blower comprising a blower body on one side of an electric motor in the axial direction and a cooling fan on the other side of said motor and having an intake port and a discharge port, wherein said muffling apparatus is constructed according to any one of preceding claims 1, 2, 3 or 4 and is stackable one above another in several stages through a frame.

12. A blower muffling apparatus according to claim 11, wherein said muffling apparatus is stacked in plural with intake ports and exhaust ports of the apparatus located on the same side thereof.

13. A blower muffling apparatus according to claim 11, wherein casters for movement of the apparatus are attached to the bottom of a lowermost stage of said frame.

14. A blower muffling apparatus according to claim 11, wherein surrounding surfaces of said frame are covered with facing plates or the like.

15. A blower muffling apparatus which houses a blower comprising a blower body on one side of an electric motor in the axial direction and a cooling fan on the other side of said motor and having an intake port and a discharge port, wherein said muffling apparatus is constructed according to any one of preceding claims 5, 6, 7, 8, 9 or 10 and is stackable one above another in several stages through a frame.

* * * * *